US006698358B2

(12) United States Patent
Theurer et al.

(10) Patent No.: US 6,698,358 B2
(45) Date of Patent: Mar. 2, 2004

(54) MACHINE FOR PICKING UP TIES OF A TRACK

(75) Inventors: Josef Theurer, Vienna (AT); Manfred Brunninger, Altenberg (AT)

(73) Assignee: Franz Plasser Bahnbaumaschinen-Industriegesellschaft mbH, Vienna (AT)

( * ) Notice: Subject to any disclaimer, the term of this patent is extended or adjusted under 35 U.S.C. 154(b) by 0 days.

(21) Appl. No.: 10/461,906

(22) Filed: Jun. 13, 2003

(65) Prior Publication Data

US 2004/0003748 A1 Jan. 8, 2004

(30) Foreign Application Priority Data

Jul. 17, 2002 (AT) ..... 475/2002 U

(51) Int. Cl.[7] ..... E01B 27/00
(52) U.S. Cl. ..... 104/2; 104/9
(58) Field of Search ..... 104/2, 9, 5, 7.1, 104/7.2, 7.3, 12

(56) References Cited

U.S. PATENT DOCUMENTS 4,606,274 A * 8/1986 Cicin-Sain et al. ..... 104/6
4,867,068 A * 9/1989 Valditerra ..... 104/2
4,924,042 A * 5/1990 Valditerra ..... 104/9
5,337,675 A * 8/1994 Aubermann ..... 104/2
5,357,867 A 10/1994 Theurer et al.
6,415,720 B2 * 7/2002 Theurer et al. ..... 104/7.3
6,474,241 B2 * 11/2002 Theurer et al. ..... 104/9

* cited by examiner

*Primary Examiner*—Mark T. Le
(74) *Attorney, Agent, or Firm*—Laurence A. Greenberg; Werner H. Stemer; Ralph E. Locher

(57) ABSTRACT

A machine picks up ties from a ballast bed of a track while advancing continuously in an operating direction. A machine frame carries a tie transport unit onto which a tie pick-up device transports the ties. The pick-up device has tie skids immersed in the ballast bed for supporting the ties to be lifted. The tie skids are extended backward by a tie sliding track on which the underside of the ties is supported and the ties are slid to the tie transport unit. The tie sliding track extends in the longitudinal direction and it has a transfer end at which the ties are transferred to a receiving end of the tie transport unit. An endless transporting chain with tie engaging members shifts the ties from the ballast bed to the receiving end of the tie transport unit. The transporting chain has a lower deflection end that lies ahead of its upper deflection end and it extends along a reference line that encloses an acute angle with the ballast bed.

5 Claims, 1 Drawing Sheet

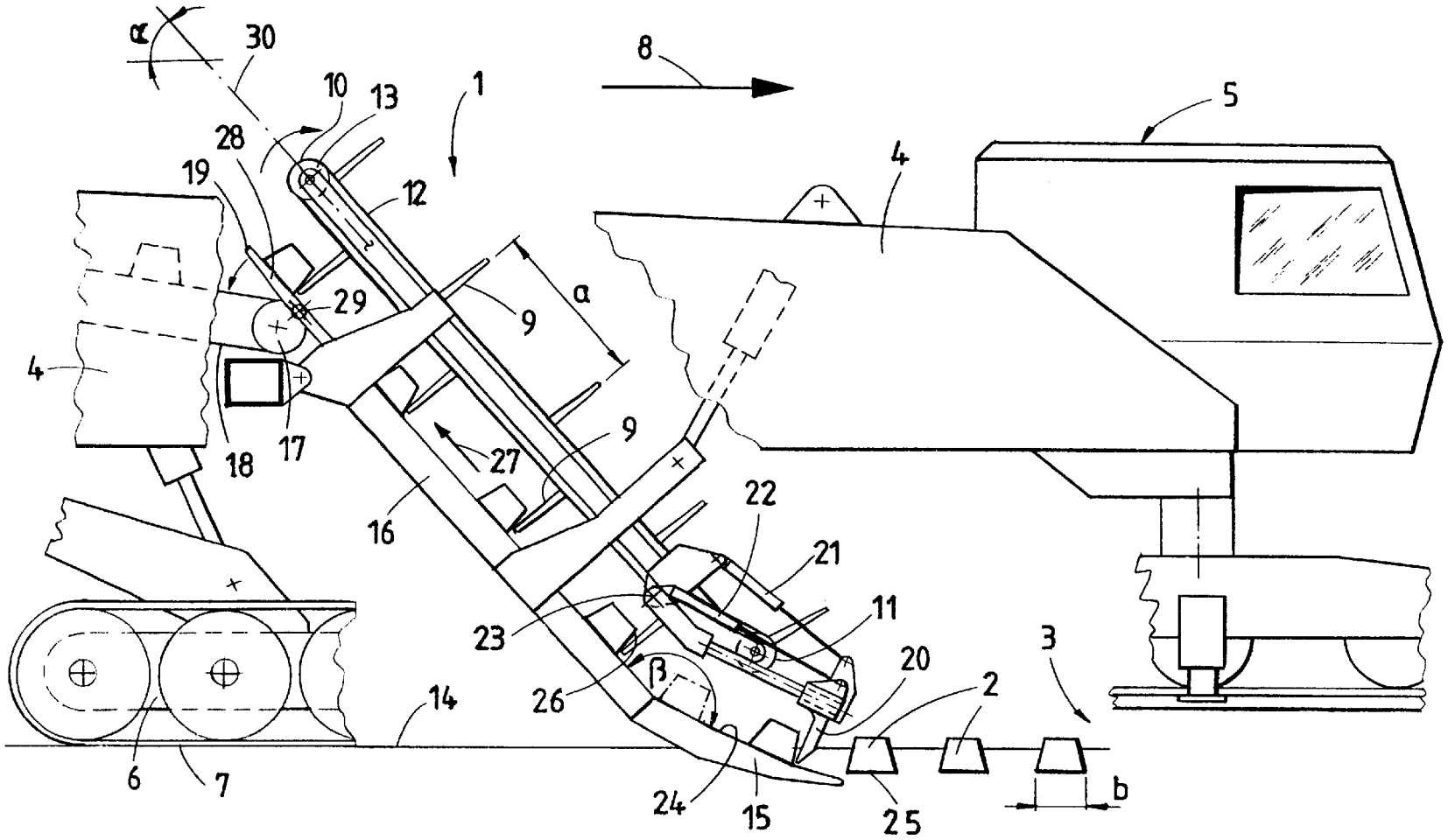
1
2
3
4
5
6
7
8
9
10
11
12
13
14
15
16
17
18
19
20
21
22
23
24
25
26
27
28
29
30
a
b
α
β

MACHINE FOR PICKING UP TIES OF A TRACK

BACKGROUND OF THE INVENTION

1. Field of the Invention

The present invention relates, in general, to a machine for picking up ties of a track while advancing continuously in an operating direction. The ties rest with their underside on a ballast bed.

2. Description of the Related Art

Our earlier U.S. Pat. No. 5,357,867 describes a machine of this type. The old ties which are to be removed in the course of a track renewal operation are lifted off the ballast bed by the tie pick-up device and stored intermediately on the machine. To that end, the tie is initially gathered up by the tie skids, then collected from there by way of a pivotable and vertically adjustable fork which lifts the tie and deposits it, with underside of the tie down, upon an engaging member of an endless transporting chain. The latter finally transports the tie to a tie transport unit positioned at an elevated location.

SUMMARY OF THE INVENTION

It is an object of the invention to provide a machine for picking up ties of a track that overcomes the disadvantages of the heretofore-known devices and methods of this general type and which provides for an improved machine that allows the tie picking-up operation to be carried out in a more efficient manner.

With the foregoing and other objects in view there is provided, in accordance with the invention, a machine for picking up ties of a track while advancing continuously in an operating direction, the ties having an underside resting on a ballast bed. The machine comprises a machine frame extending in a longitudinal direction; a tie transport unit arranged on the machine frame and having a receiving end; and a tie pick-up device associated with the tie transport unit. The tie pick-up device includes tie skids provided for permanent immersion in the ballast bed for support of the ties to be lifted, the tie skids being lengthened by a tie sliding track for supporting the underside of the ties, the tie sliding track extending substantially in the longitudinal direction and having a transfer end arranged in the region of the receiving end of the tie transport unit; and an endless transporting chain provided for shifting the ties from the ballast bed to the receiving end of the tie transport unit, the transporting chain comprising engaging members and having an upper and a lower deflection end which define a reference line disposed at an angle of less than 90° with regard to the ballast bed, with the lower deflection end being positioned ahead of the upper deflection end in the operating direction In accordance with an added feature of the invention, there is provided a tie pusher disposed in a region of the lower deflection end and above the tie skids, a first drive disposed to displace the tie pusher in the longitudinal direction relative to the lower deflection end and a second drive for pivoting the tie pusher about an axis extending perpendicularly to the longitudinal direction.

In accordance with an additional feature of the invention, a spacing distance between any two adjacent engaging members of the transporting chain is at least twice the given tie width.

In accordance with an additional feature of the invention, the tie skids are formed with a skid sliding surface enclosing an angle of between 130° and 160° with the tie sliding track.

In accordance with a concomitant feature of the invention, there is provided a deflection flap pivotally mounted at the transfer end of the tie sliding track about an axis extending perpendicularly to the longitudinal direction, for transferring a tie onto the tie transport unit.

A solution of this kind offers the advantage that the old tie to be removed is displaced in a sliding manner, starting from the tie skids all the way to the upper end of the tie pick-up device, thus rendering superfluous any efficiency-limiting transfer cycle of a single tie, such as described at the beginning. This structural solution also provides for a buffering possibility in the region of the tie skids on which, if necessary, even two immediately adjacent ties can be collected at the same time by the engaging member and displaced vertically without problems. Thus, in a particularly advantageous manner, even the presence of double ties, for example at a rail joint, does not lead to an impairment or reduction of the working performance and efficiency of the machine.

Other features which are considered as characteristic for the invention are set forth in the appended claims.

Although the invention is illustrated and described herein as embodied in a machine for picking up ties of a track, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The sole drawing FIGURE shows a partial side view of a machine for picking up ties, with a segment of the machine frame broken away to provide a clearer view of a tie pick-up device.

DESCRIPTION OF THE PREFERRED EMBODIMENTS

Referring now to the FIGURE of the drawing in detail, there is shown, in side view, a portion of a machine 5 provided for the renewal of a track 3, such as a railroad track. The track 3 includes ties 2 having an underside 25 resting on a ballast bed 14. The machine 5 comprises a machine frame 4, extending in a longitudinal direction, and it is mobile in an operating direction 8 by way of a track-driven undercarriage 7. The latter is equipped with a motive drive 6 and, during working operations, rolls on the ballast bed 14 of the track 3.

A tie pick-up device 1 for picking up ties 2 of the track 3 is connected to the machine frame 4. The tie pick-up device 1 primarily consists of an endless transporting chain 12 which is associated with a rotary drive 13 and comprises a multitude of engaging members 9. The transporting chain 12 revolves around an upper deflection end 10 and a lower deflection end 11, the two deflection ends defining a reference line 30. The transporting chain 12 is arranged in such a way that the reference line 30 is inclined relative to the ballast bed 14 at an angle $\alpha$ which is smaller than 90°, with the lower deflection end 11 being positioned ahead of the upper deflection end 10 in the operating direction 8. A spacing distance a between any two adjacent engaging members 9 amounts to at least twice a width b of a tie 2, as measured in the longitudinal direction.

Two tie skids 15 are located underneath the lower deflection end 11. The two tie skids 15 are spaced from one another transversely to the longitudinal direction. The tie skids 15 are continued, or rather lengthened, by way of a tie sliding track 16 extending substantially in the longitudinal direction and parallel to the transporting chain 12. The tie sliding track 16 terminates in a transfer end 19. A tie transport unit 18, shown only partially and mounted on the machine frame 4, includes a receiving end 17 which is positioned in the vicinity of the transfer end 19.

A tie pusher 20, which is positioned above the tie skids 15, is provided in the region of the lower deflection end 11. The tie pusher 20 is mounted on the transporting chain 12 for pivoting, by means of a drive 21, about an axis 23 extending perpendicularly to the longitudinal direction, and is displaceable in the longitudinal direction by means of another drive 22. The tie skids 15 include a skid sliding surface 24 which is angled with regard to the tie sliding track 16 at an angle β which lies preferably within a range of 130° to 160°.

In working operations, the machine 5 advances continuously in the operating direction 8. In the course of this movement, the tie skids 15 are shoved under the underside 25 of the tie 2 to be removed. Parallel thereto, the tie pusher 20 is raised by means of the drives 21 and 22, pushed forward in the operating direction and lowered immediately in front of the preceding tie 2 (the position is represented in solid lines). Subsequently, the tie pusher 20, together with the tie 2, is pushed back in the direction towards the tie sliding track 16 (the tie drawn in dash-dotted lines). In the meantime, the rotation of the transporting chain 12 by the rotary drive 13 causes engaging members 9 to be applied to a forward-facing side surface 26 of the tie 2, thus pushing the tie 2 along the tie sliding track 16 in a direction indicated by an arrow 27.

This cycle for picking-up ties 2 is repeated while the machine 5 advances continuously. During the same time, as a result of the permanent rotation of the transporting chain 12, the ties 2 that are disposed on the tie sliding track 16 are transported in the direction 27 towards the receiving end 17 of the tie transport unit 18. As soon as a tie 2 reaches the receiving end 17, a deflection flap 28 mounted to the tie sliding track 16 is pivoted about an axis 29, extending perpendicularly to the longitudinal direction, and the tie 2 is thus moved onto the receiving end 17, to be removed by the tie transport unit 18.

A particular advantage of the tie pick-up device 1 lies in the fact that, if the machine 5 is advancing at correspondingly fast speed, a second tie 2 can easily be pushed onto the skid sliding surface 24 next to the one already positioned there, and both ties 2 can then be transported upwards together by way of one and the same engaging member 9.

While the invention has been illustrated and described as embodied in a machine for picking up ties of a track, it is not intended to be limited to the details shown since various modifications and structural changes may be made without departing in any way from the spirit of the present invention.

We claim:

1. A machine for picking up ties of a track while advancing continuously in an operating direction, the ties having an underside resting on a ballast bed, the machine comprising:

a machine frame extending in a longitudinal direction;

a tie transport unit disposed on said machine frame and having a receiving end; and a tie pick-up device associated with said tie transport unit and including tie skids configured for permanent immersion in the ballast bed and for supporting ties to be lifted, a tie sliding track adjoining said tie skids and lengthening said tie skids for supporting the underside of the ties, said tie sliding track extending substantially in the longitudinal direction and having a transfer end at said receiving end of said tie transport unit; and an endless transporting chain for transporting the ties from the tie skids to said receiving end of said tie transport unit, said transporting chain comprising engaging members and having upper and lower deflection ends defining a reference line enclosing an angle of less than 90° with the ballast bed, with said lower deflection end being positioned ahead of said upper deflection end in the operating direction.

2. The machine according to claim 1, which further comprises a tie pusher disposed in a region of said lower deflection end and above said tie skids, a first drive disposed to displace said tie pusher in the longitudinal direction relative to said lower deflection end and a second drive for pivoting said tie pusher about an axis extending perpendicularly to the longitudinal direction.

3. The machine according to claim 1, wherein the ties have a given tie width measured in the longitudinal direction, and a spacing distance between any two adjacent said engaging members of said transporting chain corresponds to at least twice the given tie width.

4. The machine according to claim 1, wherein said tie skids are formed with a skid sliding surface enclosing an angle of between 130° and 160° with said tie sliding track.

5. The machine according to claim 1, which further comprises a deflection flap pivotally mounted at said transfer end of said tie sliding track about an axis extending perpendicularly to the longitudinal direction, for transferring a tie onto the tie transport unit.

* * * * *